US011028652B1

(12) United States Patent
Willey

(10) Patent No.: US 11,028,652 B1
(45) Date of Patent: Jun. 8, 2021

(54) AUGER STAND FOR DIGGER DERRICK

(71) Applicant: Altec Industries, Inc., Birmingham, AL (US)

(72) Inventor: Charles D. Willey, Roanoke, VA (US)

(73) Assignee: Altec Industries, Inc., Birmingham, AL (US)

( * ) Notice: Subject to any disclaimer, the term of this patent is extended or adjusted under 35 U.S.C. 154(b) by 0 days.

(21) Appl. No.: 16/998,151

(22) Filed: Aug. 20, 2020

(51) Int. Cl.

| | |
|---|---|
| ***E21B 10/44*** | (2006.01) |
| ***E21B 15/00*** | (2006.01) |
| ***E21B 7/00*** | (2006.01) |
| *E21B 7/02* | (2006.01) |

(52) U.S. Cl.
CPC ..... *E21B 15/00* (2013.01); *E21B 7/005* (2013.01); *E21B 7/02* (2013.01)

(58) Field of Classification Search
CPC . E21B 15/00; E21B 7/005; E21B 7/02; E21B 10/44
USPC ..... 175/57
See application file for complete search history.

(56) References Cited

U.S. PATENT DOCUMENTS 2,385,441 A * 9/1945 Hill ..... A01B 1/00 172/25
5,090,486 A * 2/1992 Jones ..... E21B 19/086 173/140
5,377,767 A * 1/1995 Briggs ..... E21B 7/023 173/28
6,125,776 A * 10/2000 Carmichael ..... A01C 5/04 111/113
7,757,780 B2 * 7/2010 Pollock ..... E02F 3/06 173/185
8,734,075 B1 5/2014 King et al.
2009/0120655 A1 * 5/2009 Hansen ..... E01C 23/092 172/19
2012/0031679 A1 * 2/2012 Pollock ..... E21B 7/028 175/195

FOREIGN PATENT DOCUMENTS

JP 4828050 B2 11/2011

* cited by examiner

*Primary Examiner* — Taras P Bemko
(74) *Attorney, Agent, or Firm* — Erise IP, P.A.

(57) ABSTRACT

An auger stand, system, and method of use thereof for lifting a longitudinal object. The auger stand comprises at least one wall section forming a hollow inner cavity for receiving an auger, a landing to support a load from the auger and provide an upward thrust, and a base for supporting the auger stand including an anchoring mechanism to prevent rotation of the auger stand. During operation, the auger is rotated in a first direction to screw into the auger stand and rotated in a second direction to unscrew from the auger stand and lift the longitudinal object. The auger stand may also be used as a cover to protect the auger and a stand to support the auger in an upright position.

20 Claims, 7 Drawing Sheets

AUGER STAND FOR DIGGER DERRICK

BACKGROUND

1. Field

Embodiments of the invention relate to digger derrick systems. More specifically, embodiments of the invention relate to providing an auger stand for use with digger derrick systems.

2. Related Art

Digger derricks are used to maintain and install utility poles by digging holes using an auger and additionally, lifting and setting the poles using various methods combining boom, winch, swing, and pole guide functions. Digger derricks are frequently used in a manner for which they are not specifically designed, such as for pulling poles out of the ground by moving a pole side to side using the boom and simultaneously winching or moving the boom upwards. Such a manner of operation imparts dynamic loads on the digger derrick which can lead to damage and even catastrophic failure in some circumstances. Some systems employ separate stand-alone pole pulling systems which work independently from the digger derrick. However, such systems are expensive and may crowd workspace when used near the digger derrick. Therefore, there is a need for a system and method specifically designed for lifting a utility pole from the ground using a digger derrick without damaging the boom.

Further, there is currently no cover designed to be placed over the auger of the digger derrick when the auger is stowed on the boom. Thus, when stowed, the auger is vulnerable to the elements, potentially leading to physical damage and rust.

SUMMARY

Embodiments of the invention solve the above-mentioned problems by providing system and method to lift a pole using an auger stand. In some embodiments, the system comprises a utility vehicle, a boom, a digger assembly, and an auger stand. In some embodiments, the auger stand can also be used both as a cover to protect an auger of the digger assembly and as a stand to hold the auger upright.

A first embodiment of the invention is directed to an auger stand for receiving an auger of a digger derrick system, the auger stand comprising at least one wall section forming a hollow inner cavity configured to receive the auger therein, a landing secured to an interior surface of the at least one wall section within the inner cavity to support a load from the auger and provide an upward thrust, and a base for supporting the auger stand, the base comprising an anchoring mechanism to prevent rotation of the auger stand.

A second embodiment of the invention is directed to a method for lifting a longitudinal object using a digger derrick system including an auger, the method comprising the steps of providing an auger stand comprising at least one wall section forming a hollow inner cavity, a landing secured to an interior surface of the at least one wall section within the inner cavity, and a base comprising an anchoring mechanism, positioning a blade of the auger within the inner cavity of the auger stand such that the blade is in contact with the landing of the auger stand, securing the anchoring mechanism of the auger stand into the ground to prevent rotation of the auger stand, securing the longitudinal object to the digger derrick system after the auger is screwed into the auger stand, and rotating the auger in an extraction direction opposite from a digging direction of the auger such that the blade of the auger is unscrewed from the auger stand to lift the longitudinal object.

A third embodiment of the invention is directed to a system for lifting a longitudinal object, the system comprising a boom comprising a proximal end and a distal end, a digger assembly attached to the distal end of the boom, the digger assembly comprising an auger, and a digger motor for driving rotation of the auger, and an auger stand configured to be placed over the auger of the digger assembly, the auger stand comprising at least one wall section forming a hollow inner cavity configured to receive the auger therein, a landing secured to an interior surface of the at least one wall section within the inner cavity to support a load from the auger and provide an upward thrust, and a base for supporting the auger stand, the base comprising an anchoring mechanism to prevent rotation of the auger stand.

Additional embodiments of the invention are directed to a system comprising a collapsible auger stand operable to be used in combination with a digger derrick system to lift a pole and to be folded when not in use.

Further embodiments of the invention are directed to a system comprising a slotted auger stand operable to be used in combination with a digger derrick system to lift a pole.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
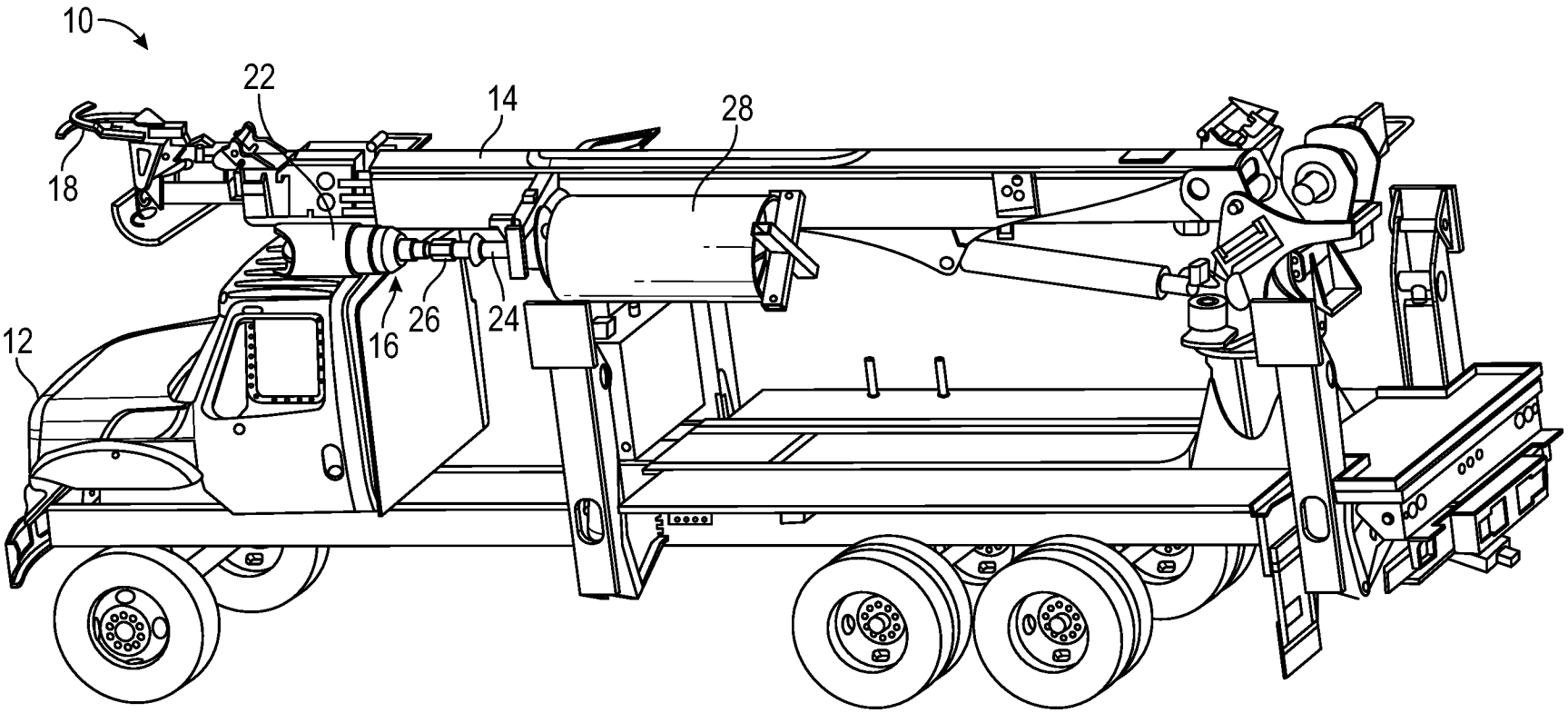
FIG. 1 is a digger derrick system for some embodiments of the invention.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Figure 7:
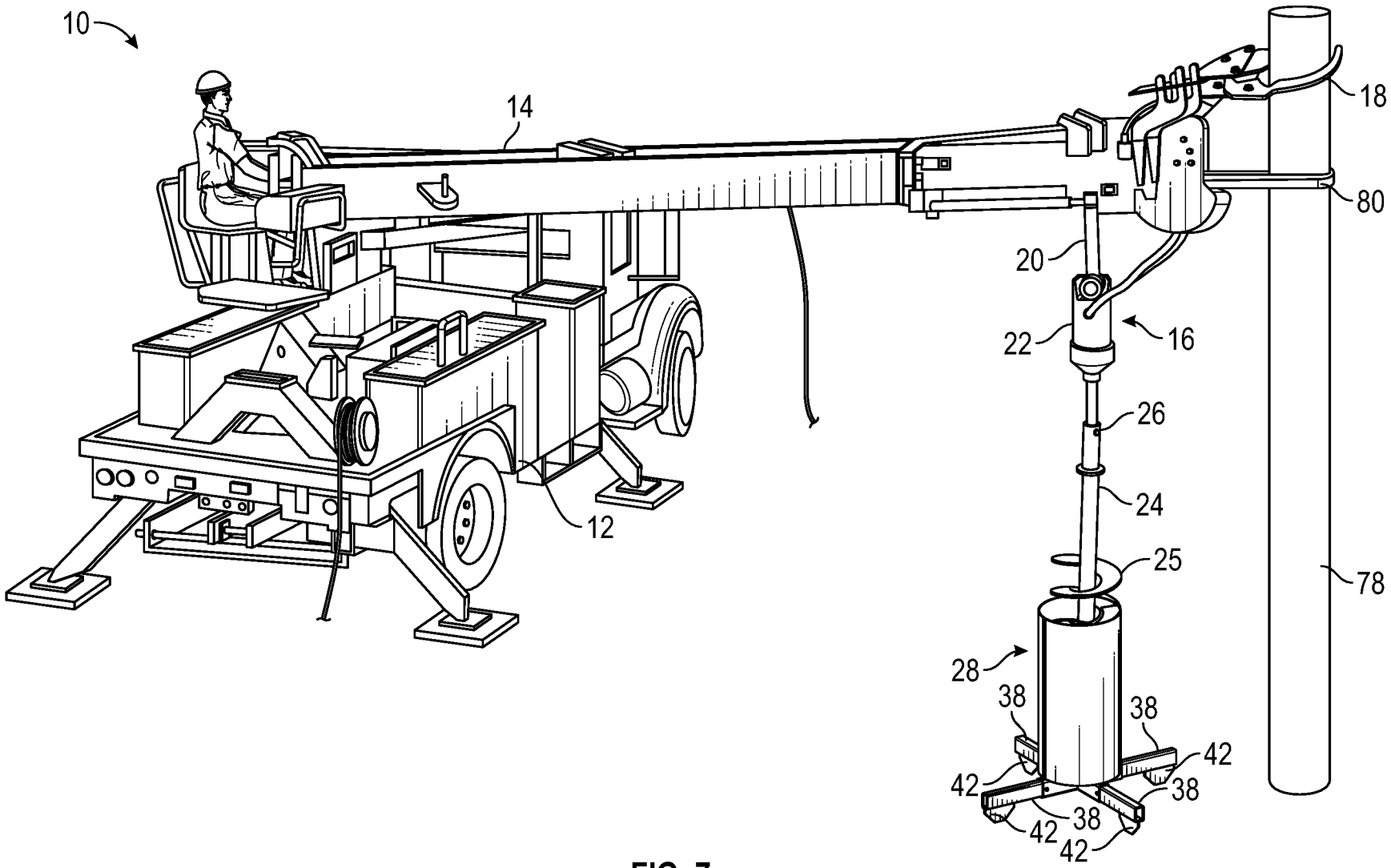
FIG. 7 shows an exemplary operational environment for some embodiments of the invention.

FIG. 1 depicts a digger derrick system 10 for some embodiments of the invention. The digger derrick system 10 comprises a utility vehicle 12, a boom 14, and a digger assembly 16. The boom 14 comprises a proximal end attached to the utility vehicle 12 and a distal end supporting a grapple 18 and the digger assembly 16. In some embodiments, the boom 14 is one of a telescoping boom and an articulating boom. In some embodiments the grapple 18 is used for grasping objects. For example, the grapple 18 may be used to grasp a pole, such as pole 78 as shown in FIG. 7. The boom 14 further comprises a rotating linkage 20, shown in FIG. 7, for rotatably attaching the digger assembly 16 to the boom 14. In some embodiments, the boom 14 further comprises a hydraulic circuit for transmitting hydraulic power and extending/retracting the boom 14. The digger assembly 16 comprises a digger motor 22 and an auger 24 having a blade 25, as shown in FIG. 2B. In some embodiments, the auger 24 is secured to the digger assembly 16 using a kelly bar 26. An auger stand 28 may be placed over the auger 24, as shown. It should be understood that in some embodiments the digger assembly 16 is not necessarily attached to the boom 14. Instead, the digger assembly 16 can be alternatively attached to a crane or any other device. Further, in some embodiments, the digger assembly 16 may not be attached to any device and is stored in the auger stand 28.

In some embodiments, the digger assembly 16 may be in the stowed position at the side of the boom 14, as shown in FIG. 1. Here, the auger stand 28 may be placed over the auger 24 as a cover to protect the auger 24 when the auger 24 is not in operation. Alternatively, during operation the auger stand 28 is used to provide an upward thrust to the auger 24 to lift the pole 78. The digger motor 22 of the digger assembly 16 is operable to rotate the auger 24 in a first direction associated with a digging operation of the auger 24. Such rotation is used to dig into the ground and/or to screw into the auger stand 28. Additionally, the digger motor 22 is operable to rotate the auger 24 in a second direction opposite the first direction. Said second direction is associated with an extraction operation of the auger 24 and/or unscrewing the auger 24 from the auger stand 28. For example, during operation, the digger motor 22 rotates the auger 24 in the first direction to screw the auger 24 into the auger stand 28, and then rotates the auger 24 in the second direction to unscrew the auger 24 from the auger stand 28.

Figure 2A:
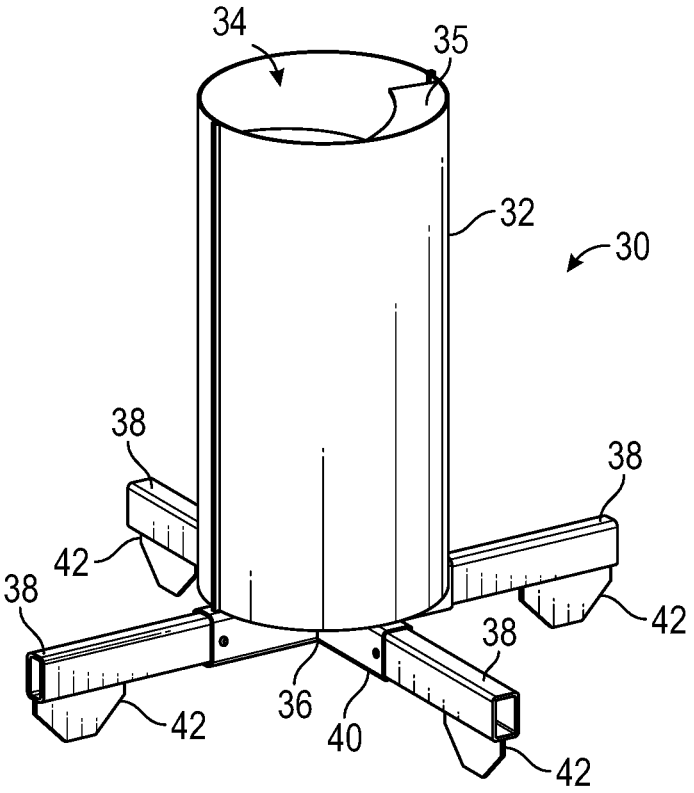
FIG. 2A is first embodiment of the invention showing a tubular auger stand.
Figure 2B:
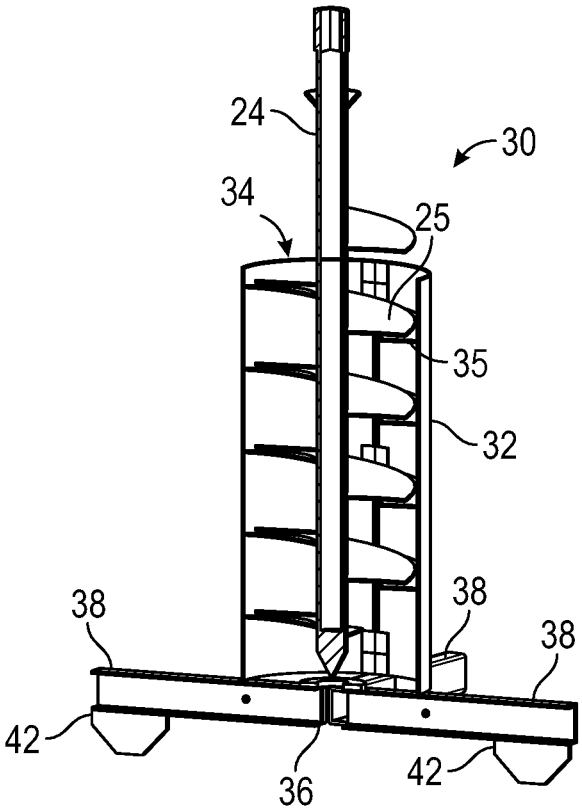
FIG. 2B is a cross-sectional view of the first embodiment of the invention.

FIG. 2A shows a first embodiment of the invention as a tubular auger stand 30. In such embodiments, the auger stand 28 may be the tubular auger stand 30. Said tubular auger stand 30 comprises at least one outer wall section 32, at least one interior landing section 34, and a base 36. The wall section 32, in some embodiments, forms a hollow cylindrical inner cavity for receiving the auger 24 therein. The landing 34, in some embodiments, comprises a load-bearing flight 35 for transferring a load from the auger 24 while in use. Said load-bearing flight 35, in some embodiments, is substantially helix-shaped, corresponding to the blade 25 of the auger 24. Thus a bottom surface of the blade 25 contacts a top surface of the load-bearing flight 35 when the auger 24 is placed in the auger stand 28. Further, in some embodiments, the load-bearing flight 35 comprises a threading as shown, where the threads correspond to the shape of the auger blade 25, such that the auger 24 can be screwed into the tubular auger stand 30. Alternatively, in a second embodiment, the landing 34 comprises a plurality of rollers, such as rollers 60 as discussed further below with respect to FIG. 4A. Alternatively, the landing 34 may comprise a plurality of any other type of known plain-bearing thrust elements configured to provide an upwards thrust to the auger 24 during operation.

In some embodiments, the wall section 32 of tubular auger stand 30 may be cylindrical, as shown. However, embodiments are contemplated where the wall section 32 is not cylindrical. As such, it should be understood that, in some embodiments, the wall section 32 may be any suitable shape to receive the auger 24. For example, in some embodiments, the wall section 32 may be rectangular with a cylindrical interior opening to receive the auger 24. Additionally, in some embodiments the wall section 32 may be composed of multiple parts, which may be removably joined together using a fastener, or permanently joined together using a joining process, such as welding or any other suitable joining process. Alternatively, in some embodiments, the wall section 32 is manufactured as a single part.

The base 36 holds the auger stand 28 vertically upright. In some embodiments, the base 36 comprises a hub 40 and a plurality of legs 38 attached to the hub 40. In some embodiments, the base 36 comprises four legs 38 extending radially outwards from the hub 40 of the auger stand 28. In other embodiment the base 36 may comprise any number of legs. The base 36 further comprises an anchoring mechanism, such as at least one spade portion 42. The spade portion 42, in some embodiments, may be secured to the end of each respective leg 38 of the base 36. When in use, the spade portion 42 can be inserted into a surface, such as the ground to prevent movement of the auger stand 28.

In some embodiments, the plurality of legs 38 are removably attached to the hub 40 of the base 36. In such embodiments, it may be desirable to remove the legs 38 when stowing the auger stand 28 to reduce the size of the auger stand 28. In such embodiments, the legs 38 may be removably attached to the hub 40 via mechanical fasteners, such as, for example, screws, bolts, latches, or any other known fasteners. Alternatively, in some embodiments, the legs 38 may be permanently attached to the hub 40. In such embodiments, the legs 38 may be welded to the hub 40 or otherwise secured.

In some embodiments, the spade portion 42 may be fin-shaped, as shown. It should be understood that a variety of shapes and sizes are contemplated for the spade portion 42, such as pointed or rectangular with a serrated edge. In some embodiments, the shape and size of the spade portion 42 is selected based on operational parameters, such as soil condition and auger size. In some embodiments, any suitable shape and size for the spade portion 42 is selected such that the spade portion 42 is operable to prevent movement of the auger stand 28 when in use. In some embodiments, the spade portion 42 is removably attached to the legs 38 via a mechanical fastener, which may be any mechanical fastener such as a screw, a latch, a bolt, or any other known mechanical fastener. Alternatively, the spade portions 42 may be permanently attached to the legs 38, such as via welding or other known processes.

FIG. 2B shows a cross-sectional view of the tubular auger stand 30 with the auger 24 inserted. In some embodiments, the load-bearing flight 35 is secured to the interior opening of the wall section 32, as shown. In some embodiments, the interior opening of the wall section 32 is cylindrical, as shown, and the load-bearing flight 35 is substantially helical to receive the auger 24. The blade 25 of the auger 24 may be screwed into the load-bearing flight 35 of the auger stand 28, such that at least one bottom surface of the blade 25 is in contact with at least one top surface of the load-bearing flight 35 when the auger 24 is placed in the auger stand 28, as shown. The auger stand 28 can thereby provide an upward thrust to the auger 24 when the blade 25 is unscrewed from the auger stand 28. The auger 24 may be rotated in a first direction to screw into the auger stand 28. Said first direction is associated with a dig function of the auger 24. The auger 24 may be rotated in a second direction opposite the first direction to unscrew from the auger stand 28. While the auger 24 is rotated in the second direction i.e. the extraction direction, the spade portions 42 penetrate into the ground to prevent rotation of the auger stand 28, such that the rotation of the auger blade 25 in the extraction direction drives the auger 24 upwards along the load-bearing flight 35.

In some embodiments, the load-bearing flight 35 may be a single part positioned on the interior of the wall section 32, as shown. However, it should be understood that in some embodiments, the load-bearing flight 35 may comprise a plurality of distinct load-bearing platforms spaced along the interior of the wall section 32. Here, the plurality of platforms may be distributed along the interior of the wall section 32 according to the shape of the auger blade 25, such that the top surfaces of the platforms are configured to contact and receive the auger blade 25 and provide an upward force to the auger 24 during operation.

Figure 3:
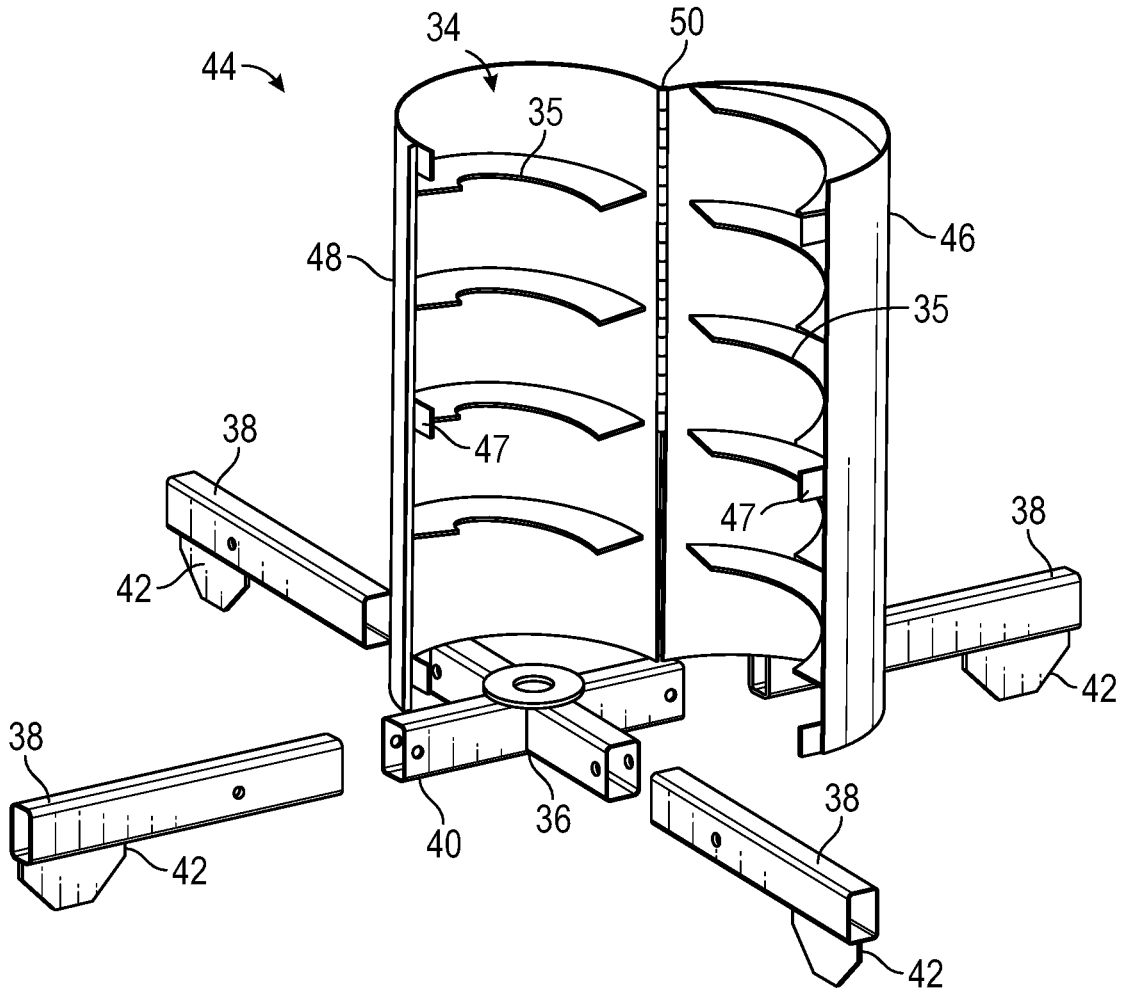
FIG. 3 is an exploded view of a second embodiment of the invention showing a hinged auger stand.

FIG. 3 shows an exploded view of a second embodiment of a hinged auger stand 44. The hinged auger stand 44 comprises a first wall portion 46 rotatably attached to a second wall portion 48 at a rotatable hinge joint 50. The landing 34 may be distributed on each of the first wall portion 46 and the second wall portion 48 as shown. The hinged auger stand 44 can be opened, as shown, and closed by rotating the first wall portion 46 and/or the second wall portion 48 about the rotatable hinge joint 50. Although two wall portions are shown, the hinged auger stand may include additional wall portions and additional hinges. In some embodiments, it may be desirable to use the hinged auger stand 44 because it can be quickly placed over and removed from the auger 24. In some such embodiments, at least one operator may open/close the hinged auger stand 44.

In some embodiments, the hinged auger stand 44 may include an automatic opening and closing mechanism (not shown), such that the operator can remotely control the opening and closing of the hinged auger stand 44. Here, it may be desirable that the operator control the automatic opening and closing mechanism using an input device which may communicate wirelessly with the automatic mechanism. The operator may then simultaneously operate the boom 14 and the hinged auger stand 44 such that a single operator can perform the step of inserting the auger 24 into the hinged auger stand 44.

In some embodiments, the hinged auger stand 44 comprises a plurality of legs 38, which may be removable from the central hub 40, as shown. Although four legs are shown, the hinged auger stand 44 may include any number of legs, such as two, three, or five. In some embodiments, it may be desirable to include varying lengths of legs 38, in addition to varying shapes and sizes of the spade portions attached thereto. The legs 38 can be removed and replaced depending on the specific application. For example, if a larger torque is required, then the legs 38 may be replaced with elongated legs that produce a greater moment arm during operation.

In some embodiments, the hinged auger stand 44 is lockable, such that the first wall portion 46 and the second wall portion 48 may be locked in the closed position using at least one locking mechanism. In some embodiments, each of the first wall portion 46 and the second wall portion 48 may include a plurality of tabs 47, as shown. The tabs 47 may be positioned to provide an interference fit when the hinged auger stand 44 is in the closed position to hold the first wall portion 46 and second wall portion 48 in place to maintain the closed position.

Figure 4B:
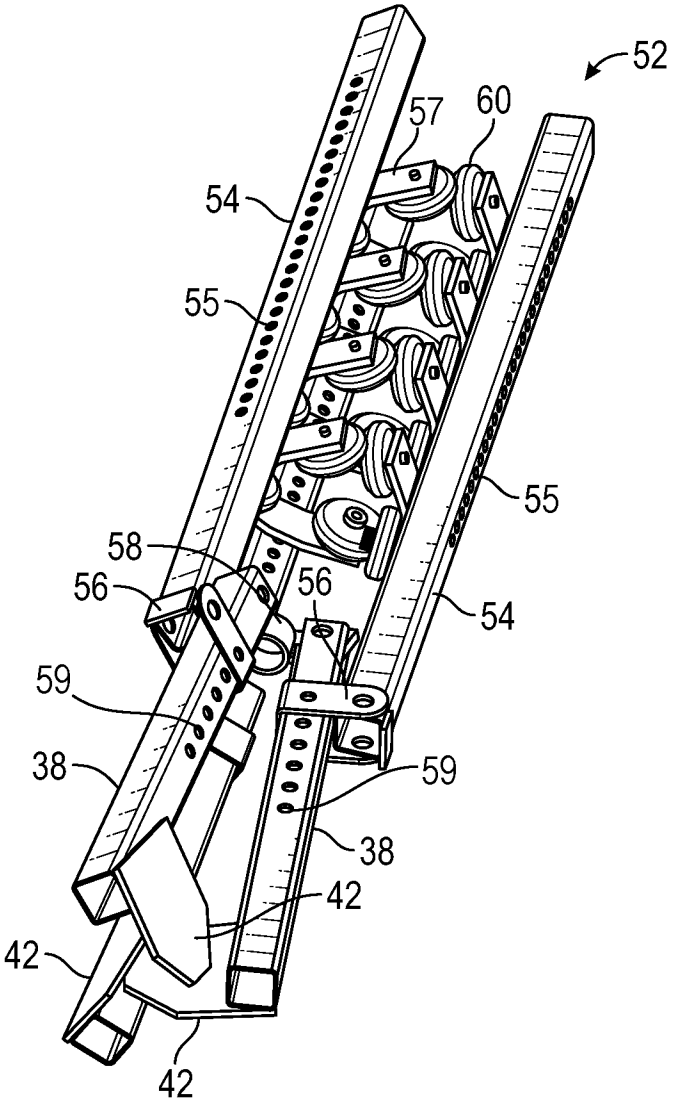
FIG. 4B is a perspective view of the third embodiment of the invention showing the collapsible auger stand in a closed configuration.
Figure 4A:
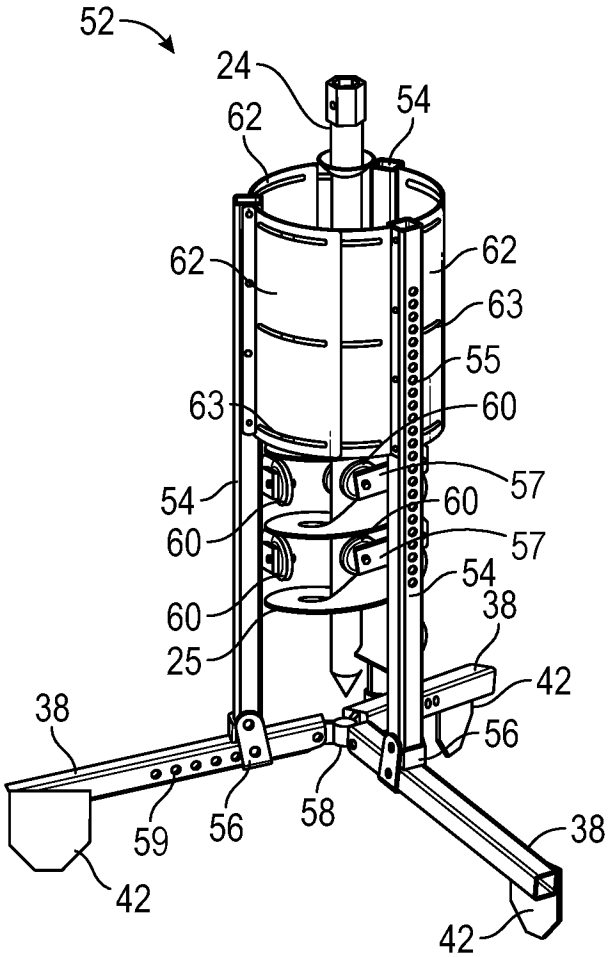
FIG. 4A is a perspective view of a third embodiment of the invention showing a collapsible auger stand in an open configuration.

FIG. 4A shows a third embodiment of a collapsible auger stand 52. The collapsible auger stand 52 comprises a plurality of foldable members 54 attached to the respective plurality of legs 38 by a plurality of pivoting slides 56. The pivoting slides 56 allow the legs 38 to pivot, such that they may be folded into the foldable members 54. In such embodiments, the plurality of legs 38 may be joined using a center hinge ring 58. The center hinge ring 58 joins the plurality of legs 38 while also allowing rotation of the legs 38. In some embodiments, the collapsible auger stand 52 comprises three legs 38 to support the collapsible auger stand 52, as shown. The collapsible auger stand 52 further comprises a plurality of rollers 60 attached along each of the foldable members 54 by attachment arms 57. Here, the attachment arms 57 may be secured to the foldable members 54 using fasteners, such as pins, screws, bolts, or any other suitable mechanical fasteners. In some embodiments, the foldable members 54 comprise fastener holes 55, as shown. Fastener holes 55 may be configured to receive a fastener therein to join the attachment arms 57 to the foldable members 54. Alternatively, in some embodiments the attachment arms 57 may be permanently joined to the foldable members 54 via welding or any other suitable joining process. Similarly, the rollers 60 may be secured to the attachment arms 57 using any suitable mechanical fastener, such that the attachment arms 57 support the rollers 60 while allowing free rotation of the rollers 60. In some embodiments, the angle of the attachment arms 57 may be adjustable. In some embodiments, the rollers 60 may be load-bearing rollers configured to support the auger blade 25. In some embodiments, the collapsible auger stand 52 further comprises a plurality of adjustable curved walls 62 secured to the plurality of foldable members 54. The curved walls 62 may be removably attached to the foldable members 54 using any suitable fastener means. For example, in some embodiments, the curved walls 62 are bolted, pinned or screwed to the foldable members. Further, in some embodiments, each of the curved walls 62 comprises slots 63. Slots 63 may be used to receive a fastener, such as a bolt, or any other suitable fastener to join the curved walls 62 to one another. Additionally, slots may be sized or shaped to decrease the weight of the walls. In one embodiment, there are six curved walls 62 on an upper portion of the collapsible auger stand 52. Two walls may be located between each member 54 and may have overlapping ends, as shown. In some embodiments, an additional six curved walls 62 may be included to cover the lower portion of the collapsible auger stand 52 (not shown). Here, the additional curved walls 62 may be positioned similar to the curved walls 62 shown in FIG. 4A with two walls located between each member 54 to cover the auger blade 25 and the rollers 60. More or less walls may be used as desired to create a cover.

FIG. 4B shows the collapsible auger stand 52 in a folded configuration for some embodiments of the invention. In some embodiments, it may be desirable to fold the collapsible auger stand 52 when the collapsible auger stand 52 is not in use or during transportation of the collapsible auger stand 52. The folded configuration of the collapsible auger stand 52 takes up less space than when unfolded. In some such embodiments, the collapsible auger stand 52 may be folded by rotating the pivoting slides 56 inward such that the legs 38 and the center hinge ring 58 are positioned between the plurality of foldable members 54. In some embodiments, the curved walls 62 may be removed before folding the collapsible auger stand 52, as shown in FIG. 4B, while in other embodiments the curved walls may remain attached to the foldable members 54 in the folded configuration. Further, in some embodiments, the curved walls 62 may not be present in the collapsible auger stand 52.

In some embodiments, each of the legs 38 comprises a plurality of holes 59, which may receive a fastener to join the legs to the pivoting slides 56. In such embodiments, the size of the collapsible auger stand 52 may be adjustable by selecting which of the plurality of holes 59 is used to join the legs 38 to the pivoting slides 56 and adjusting the position of the curved walls 62 by slots 63. For example, it may be desirable to adjust the size of the collapsible auger stand 52 to accommodate varying sizes of the auger blade 25. Here, the pivoting slides 56 may slide along the legs 38 to select a different hole 59, then the pivoting slides 56 may be secured by placing fasteners, such as bolts or any other suitable fasteners, through the selected holes 59. Similarly, the curved walls 62 may be adjusted by sliding the curved walls 62 apart and placing a fastener at a selected location in the slots 63.

In some embodiments, the collapsible auger stand 52 may comprise a locking mechanism to hold the collapsible auger stand 52 in either of the unfolded configuration (FIG. 4A) or the folded configuration (FIG. 4B). The locking mechanism may be a latch, a locking pin, a tension band, or any other locking mechanism. For example, in some embodiments, a tension band may be placed around the foldable members 54 while the collapsible auger stand 52 is in the folded configuration to maintain said folded configuration. Alternatively, in embodiments, that include a latch or a locking pin, the collapsible auger stand 52 may be locked into either configuration until the latch or locking pin is actuated to release the collapsible auger stand 52, such that the configuration can be altered. For example, a locking pin may be placed on at least one of the pivoting slides 56, such that the pivoting slides 56 are held in place by the locking pin until the locking pin is actuated by pressing the locking pin.

Figure 5:
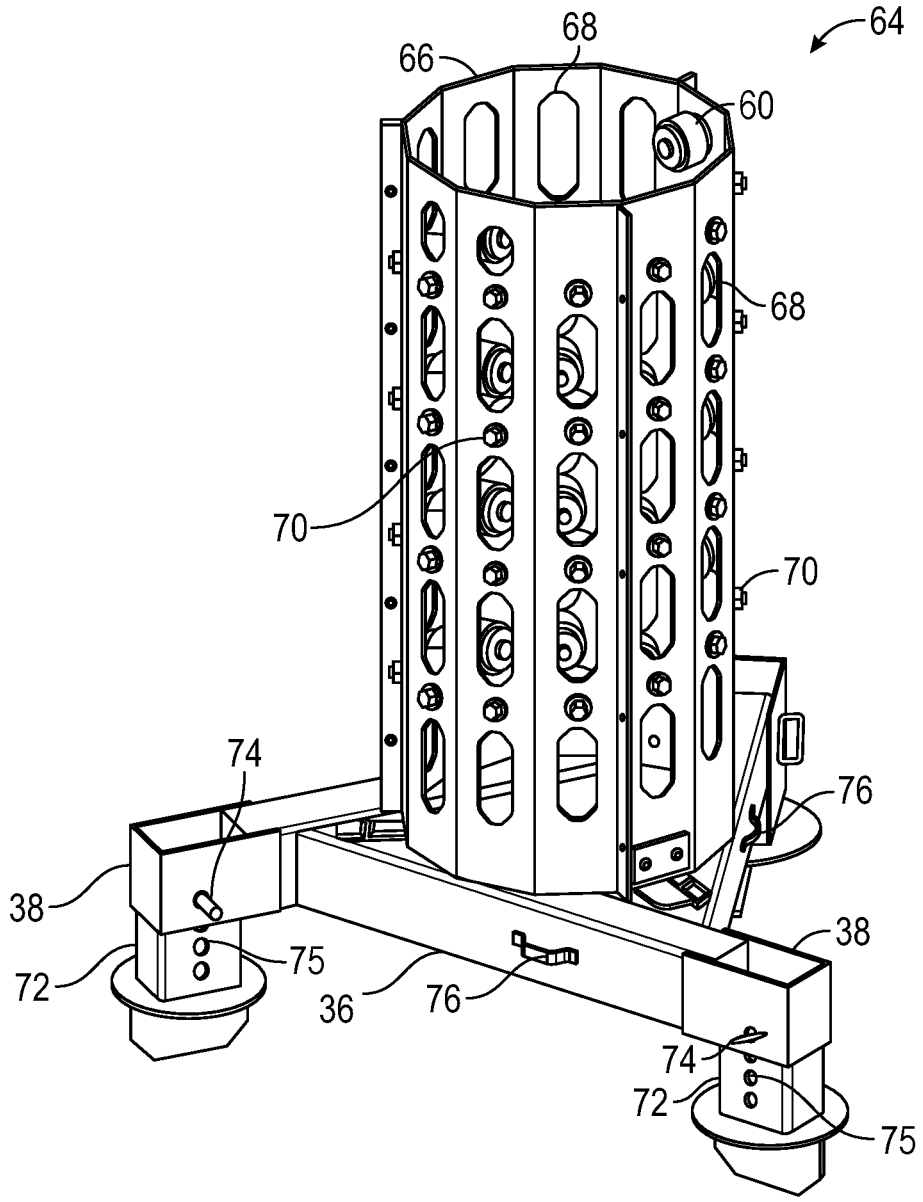
FIG. 5 is a perspective view of a fourth embodiment of the invention showing a slotted auger stand.

FIG. 5 shows a fourth embodiment of a slotted auger stand 64. The slotted auger stand 64 comprises slotted wall section 66 including a plurality of slots 68. The plurality of slots 68 reduce the weight of the slotted auger stand 64, and create ventilation to remove heat associated with use of the slotted auger stand 64. The slots 68 may be any shape or size. In some embodiments, the slotted wall section 66 includes a plurality of fastener holes 70 for receiving fasteners therein, such that the plurality of rollers 60 may be fastened to the slotted wall section 66. In such embodiments, the rollers 60 are secured directly to the slotted wall section 66 by placing a fastener, which may be any known suitable fastener, through the fastener hole 70. The fastener may extend through the fastener hole 70 and be secured directly to the roller 60. For example, in some embodiments, a bolt may extend through the fastener hole 70 and screw into a threaded portion within a bearing of the roller 60. When in use, the rollers 60 act as a landing 34 to transfer a load from the auger blade 25 to provide an upward thrust to the auger 24. The plurality of fastener holes 70 may be positioned such that the rollers 60 are aligned with the auger blade 25 of the auger 24. Thus, the auger 24 can be screwed into the slotted auger stand 64. Here, the rollers 60 may be positioned in a helix shape to accommodate the auger blade 25 of the auger 24. It should be understood that other arrangements of the rollers 60 are contemplated to accommodate varying sizes and shapes of auger blade 25. During operation, in some embodiments, the auger blade 25 of the auger 24 contacts a top surface of at least one of the rollers 60 such that the rollers 60 provide an upward force to the auger 24, when the auger 24 is rotated in the extraction direction.

In some embodiments, the slotted auger stand 64 further comprises a plurality of vertically-adjustable spade portions 72 attached to the plurality of legs 38 which are secured to the base 36 of the slotted auger stand 64. In some embodiments, the base 36 may be triangular, as shown. Here, three legs 38 may be arranged in a triangle formation to support the slotted auger stand 64 in the center. In some embodiments, the legs 38 may be permanently joined via any suitable joining process, for example, by welding. Alternatively, the legs 38 may be removably secured to one another such that the base 36 may be deconstructed, adjusted, or folded. The adjustable spade portions 72 allow the height of the slotted auger stand 64 to be adjusted. In some embodiments, the adjustable spade portions 72 may be adjusted using a fastener pin 74 configured to be placed within a plurality of pin holes 75 on the adjustable spade portion 72, as shown. In some embodiments, the slotted auger stand 64 further comprises at least one handle 76 secured to one of the plurality of legs 38 or the base 36. The handle 76 may be used for an operator to carry the slotted auger stand 64 to transport the slotted auger stand 64 or to reposition the slotted auger stand 64 before or after operation.

It should be understood that, in some embodiments, the auger stand 28 is one of the tubular auger stand 30, hinged auger stand 44, collapsible auger stand 52, and slotted auger stand 64. Further, some embodiments may include multiple auger stands and a user may select a specific type of auger stand based on the particular application. It should also be understood that any features from various embodiments may be incorporated into other embodiments even if not explicitly stated herein. For example, handle 76 shown in the slotted auger stand 64 may be used in the tubular auger stand 30. Similarly, the hinged auger stand 44 can include slots 68 to reduce the overall weight thereof. Other combinations of elements from the multiple embodiments are contemplated.

Figure 6:
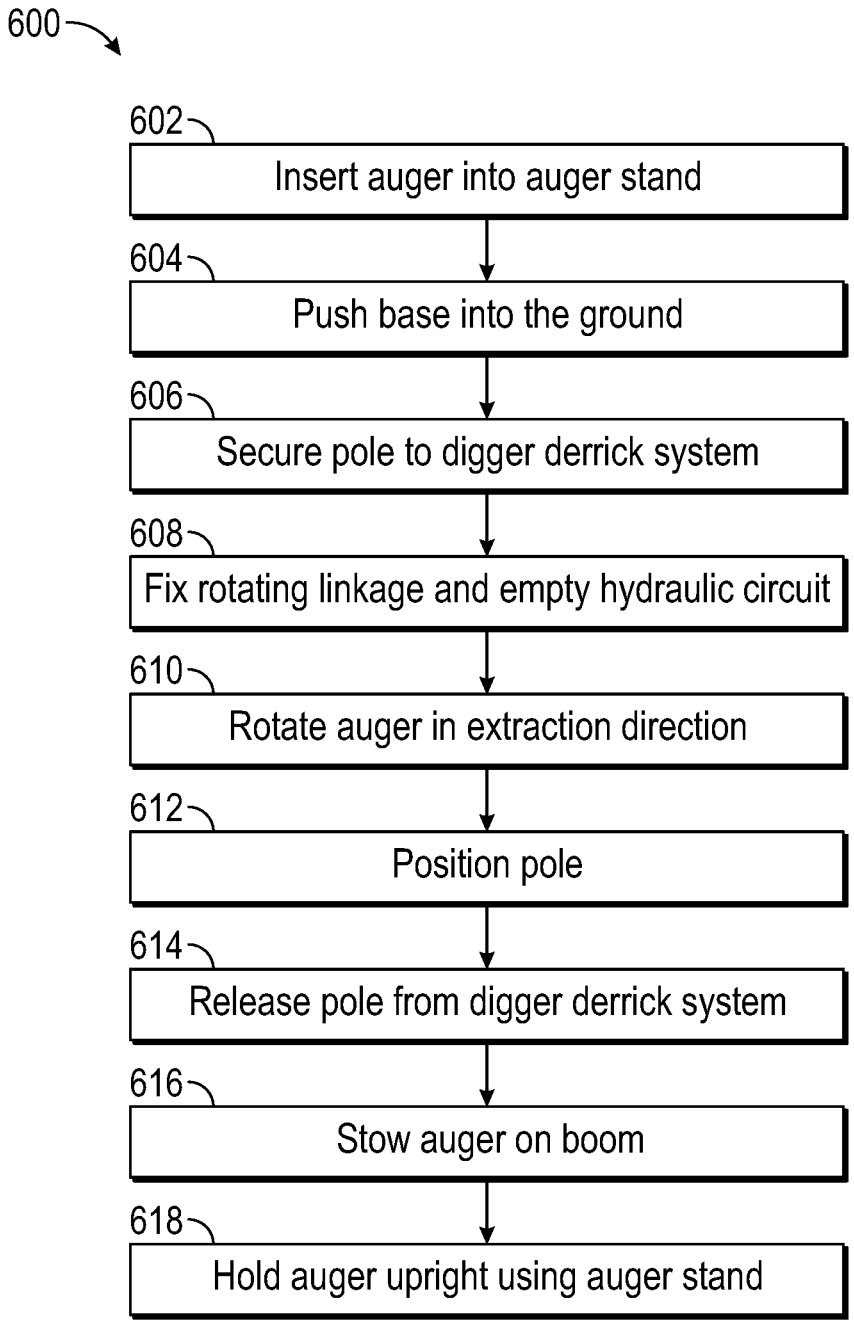
FIG. 6 illustrates a method for some embodiments of the invention.

FIG. 6 shows method 600 for some embodiments of the invention. At step 602, the auger 24 is inserted into the auger stand 28. Inserting the auger 24 into the stand may be accomplished in a variety of ways depending on the specific embodiment and application. For example, in embodiments with the tubular auger stand 30 and the collapsible auger stand 52, the auger 24 may be inserted into the auger stand 28 by rotating the auger 24 in the dig direction using the digger motor 22 thereby screwing the auger 24 into the landing 34 of the auger stand 28. Further, in embodiments with the hinged auger stand 44, the hinged auger stand 44 may be placed near the auger 24 then closed around the auger 24. For example, in some embodiments, a first operator may operate the digger derrick controls to move the boom 14 to position the auger 24 near the ground. At least one additional operator may then place the hinged auger stand 44 on the ground and close the hinged auger stand 44 around the auger 24.

At step 604, the base 36 of the auger stand 28 is pushed downwards into the ground using the boom 14. In some embodiments, pushing the base 36 downwardly pushes the spade portion 42 of the base 36 into the ground, such that the spade portions 42 are at least partially rooted into the ground to prevent rotation of the auger stand 28. This step can be accomplished by initiating a lowering operation of the boom 14, which may be carried out by an operator of the digger derrick system 10.

Next, at step 606 the pole 78 is secured to the digger derrick system 10. The pole 78 may be a utility pole, for example, a telephone pole or a power pole. It should be understood that the pole 78 may be secured to the digger derrick system 10 by any suitable means. For example, operations such as grasping the pole 78 using the grapple 18 and cinching the pole 78 using a strap, such as strap 80 shown in FIG. 7, may be used to secure the pole 78. In some embodiments, the pole 78 may be grasped using the grapple 18 then cinched using the strap 80 around the pole 78 to secure the pole 78 to the boom 14 at the distal end of the boom 14. It should be understood that the pole 78 may also be cinched at other locations of the boom 14 and the digger assembly 16 and further cinched in multiple positions. For example, in some embodiments, it may be desirable to cinch the pole 78 to the distal end of the boom 14 and to the digger motor 22.

At step 608, the rotating linkage 20 is fixed to keep the center of the load in line with the center of the boom 14 and the hydraulic circuit of the boom 14 is emptied such that the boom 14 rests on the auger 24. When not fixed, the rotating linkage 20 may swing to allow the digger assembly 16 to rotate independently from the boom 14 for stowing the digger assembly 16 at the side of the boom 14, as shown in FIG. 1. However, when fixed, the rotating linkage locks the digger assembly 16 in place aligned below the boom 14. It is desirable to lock the digger assembly 16 in place during operation of the digger assembly 16 to prevent the digger assembly 16 from swinging while the auger 24 is rotating. It is also desirable that the hydraulic circuit of the boom 14 is emptied to prevent any unintentional movement of the boom 14 during operation and so that the boom 14 rests upon the digger assembly 16. At step 610, the auger 24 is rotated in the extraction direction using the digger motor 22 such that the auger 24 is unscrewed from the auger stand 28 to lift the pole 78. Here, the landing 34 of the auger stand 28 provides an upward thrust to the auger blade 25, which is translated through the auger 24 to the boom 14 where the pole 78 is grasped. The landing 34 may comprise any of the landing components described herein, such as a load-bearing flight, a threaded portion, a plurality of rollers, and/or a plurality of plain-bearing thrust elements. During step 610 it is desirable that the rotating linkage 20 is fixed and locked in place to prevent swinging or movement of the digger assembly 16 relative to the boom 14.

At step 612, after the auger 24 is unscrewed from the auger stand 28, the pole 78 is positioned using the boom 14 according to the specific application of the invention. In some embodiments, the pole 78 may be placed on the ground or placed on the utility vehicle 12 for transport, though any placement of the pole 78 is hereby contemplated. At step 614 the pole 78 is released from the digger derrick system 10. Depending on the specific embodiment, the pole 78 may be released by opening the grapple 18 of the digger derrick system 10 or by removing the strap 80 from the pole 78. After releasing the pole 78, steps 602-612 may be repeated to lift the pole 78 higher if necessary. Such, repetition is necessary when the pole 78 must be lifted higher than a single stroke length of the auger stand 28. In some embodiments, a standard lifting stroke length of the auger stand 28 is associated with the length of the auger 24. For example, the auger stand 28 may be sized according to the length of the auger 24 such that the auger stand 28 can provide a lifting force to the entire length of the auger 24. Alternatively, in some embodiments, the auger stand 28 may be sized larger than the auger 24 such that the stroke length is increased beyond the length of the auger 24.

At step 616, the auger 24 is stowed on the boom 14. In some embodiments, the auger stand 28 may be placed over the auger 24 when stowed to act as a cover. For some embodiments, it may be desirable to remove the legs 38 of the auger stand 28 before stowing the auger 24. For example, depending on the length of the legs 38, the legs may prevent the auger 24 from properly stowing by contacting the boom 14. For this reason, it may also be desirable that the legs 38 are foldable or telescoping, such that the space that the legs 38 take up can be reduced without having to completely remove the legs 38. At step 618, the auger stand 28 is used to hold the auger 24 upright for installation on the kelly bar 26 to secure the auger 24 to the digger assembly 16. Here, the auger stand 28 may be placed near the utility vehicle 12 and the boom 14 lowered to position the kelly bar 26 of the digger assembly 16 with the auger 24. Using the auger stand 28 to hold the auger 24 upright allows the auger 24 to be easily switched out and replaced. Accordingly, an operation that would otherwise involve multiple operators holding the auger 24 upright only requires a single operator to operate the boom 14 to position the digger assembly 16 above the auger stand 28. Further, in some embodiments the auger 24 is held upright using the auger stand 28 to store the auger 24. Here, the auger 24 may be stored separate from the digger assembly 16. It may be desirable to hold the auger 24 upright during storage to prevent the auger 24 from laying on the ground, which could increase the useful life of the auger blade 25.

FIG. 7 shows an exemplary operational environment of the digger derrick system 10 for some embodiments. In such embodiments, the digger derrick system 10 is used to lift a pole 78 using the auger stand 28. The auger stand 28 may be any of the tubular auger stand 30, the hinged auger stand 44, the collapsible auger stand 52, and the slotted auger stand 64. The auger 24 of the digger assembly 16 is screwed into the auger stand 28, as shown. The pole 78 is secured to the boom 14 by grasping the pole 78 with the grapple 18 and cinching the strap 80 around the pole 78, as shown. In some embodiments, at least a portion of the strap 80 may be fixed to the boom 14. Alternatively, in some embodiments, the strap 80 is a separate component that is secured around the boom 14 during operation. Further, in some embodiments, a plurality of straps may be used. Likewise, embodiments are contemplated where the boom 14 comprises a plurality of grapples 18. While the pole 78 is secured to the boom 14, unscrewing the auger 24 from the auger stand 28 lifts the pole 78. Thus, the pole 78 can be lifted from the ground using the digger derrick system 10 without damaging equipment.

It should be understood that the digger derrick system 10 and the auger stand 28 are capable of performing any of the functionality described herein, such as the steps of the method 600. Further, the digger derrick system 10 and the auger stand 28 may include any combination of features described herein. For example, the auger stand 28 may comprise slots 68, adjustable spade portions 72, and/or rotatable hinge joint 50.

In some embodiments, the pole 78 may be any member of sufficient length, such as for example, a utility pole, a tree, a structural column, etc. Accordingly, the auger stand 28 is operable to lift any longitudinal (cylindrical, rectangular, irregularly-shaped, etc.) object and is not limited to lifting utility poles. For example, in some embodiments, the auger stand 28 may be configured to lift a tree, a structural column, or a pipe. It should be understood that in addition to lifting a longitudinal object, in some embodiments, the auger stand 28 is used to lower the longitudinal object. For example, embodiments are contemplated where the auger stand 28 is placed near a hole in the ground and the auger 24 is screwed into the auger stand 28 to lower a power pole held by the grapple 18 into the hole.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. An auger stand for receiving an auger of a digger derrick system, the auger stand comprising:
- at least one wall section forming a hollow inner cavity configured to receive the auger therein;
- a landing secured to an interior surface of the at least one wall section within the inner cavity to support a load from the auger and provide an upward thrust,
- wherein the landing forms a shape corresponding to a blade of the auger; and
- a base for supporting the auger stand, the base comprising an anchoring mechanism to prevent rotation of the auger stand.

2. The auger stand of claim 1, wherein the landing comprises at least one of: a load bearing flight, a plurality of rollers, and a plurality of plain-bearing thrust elements.

3. The auger stand of claim 1, wherein the anchoring mechanism comprises at least one spade portion configured to be inserted at least partially into the ground.

4. The auger stand of claim 1, wherein the at least one wall section comprises a plurality of wall portions joined by at least one rotatable hinge to open or close the auger stand.

5. The auger stand of claim 1, wherein the base comprises at least one leg extending radially outwards from a central portion.

6. The auger stand of claim 1, wherein a lifting stroke length of the auger stand is associated with a length of the auger.

7. The auger stand of claim 1, wherein the at least one wall section comprises a thickness and a plurality of slots extend through the thickness.

8. A method for lifting a longitudinal object using a digger derrick system including an auger, the method comprising the steps of:
- providing an auger stand comprising:
  - at least one wall section forming a hollow inner cavity;
  - a landing secured to an interior surface of the at least one wall section within the inner cavity; and
  - a base comprising an anchoring mechanism;
- positioning a blade of the auger within the inner cavity of the auger stand such that a bottom surface of the blade is in direct contact with a top surface of the landing of the auger stand;
- securing the anchoring mechanism of the auger stand into the ground to prevent rotation of the auger stand;
- securing the longitudinal object to a distal end of a boom of the digger derrick system after the auger is screwed into the auger stand; and
- rotating the auger in an extraction direction opposite from a digging direction of the auger such that the blade of the auger is unscrewed from the auger stand to lift the longitudinal object.

9. The method of claim 8, wherein the at least one wall section comprises at least one rotatable hinge, further comprising opening or closing the auger stand by rotating the at least one wall section around the at least one rotatable hinge.

10. The method of claim 8, further comprising the step of storing the auger within the auger stand when not in use.

11. The method of claim 8, wherein the anchoring mechanism comprises at least one spade portion, and securing the anchoring mechanism into the ground comprises inserting the at least one spade portion into the ground.

12. The method of claim 8, wherein securing the longitudinal object to the digger derrick system comprises at least one of: cinching with a strap or grappling with a grapple of the digger derrick system.

13. The method of claim 8, wherein the landing forms a shape corresponding to the blade of the auger.

14. A system for lifting a longitudinal object, the system comprising:
- a boom comprising a proximal end and a distal end;
- a digger assembly attached to the distal end of the boom, the digger assembly comprising:
  - an auger; and
  - a digger motor for driving rotation of the auger; and
- an auger stand configured to be placed over the auger of the digger assembly, the auger stand comprising:
  - at least one wall section forming a hollow inner cavity configured to receive the auger therein;
  - a landing secured to an interior surface of the at least one wall section within the inner cavity to support a load from the auger and provide an upward thrust,
  - wherein the landing forms a shape corresponding to a blade of the auger; and
  - a base for supporting the auger stand, the base comprising an anchoring mechanism to prevent rotation of the auger stand.

15. The system of claim 14, wherein the landing comprises at least one of: a load bearing flight, a plurality of rollers, and a plurality of plain-bearing thrust elements.

16. The system of claim 14, wherein the anchoring mechanism comprises at least one spade portion configured to be inserted at least partially into the ground.

17. The system of claim 14, wherein the at least one wall section comprises a plurality of wall portions joined by at least one rotatable hinge to open or close the auger stand.

18. The system of claim 14, wherein the base comprises at least one leg extending radially outwards from a central portion.

19. The system of claim 14, wherein a lifting stroke length of the auger stand is associated with a length of the auger.

20. The system of claim 14, wherein the at least one wall section comprises a thickness and a plurality of slots extends through the thickness.

* * * * *